US005288144A

United States Patent [19]

Guderyon

[11] Patent Number: 5,288,144

[45] Date of Patent: Feb. 22, 1994

[54] MULTI-MEDIA STORAGE AND PROTECTION SYSTEM

[76] Inventor: David A. Guderyon, 11479 Orange Grove Blvd., West Palm Beach, Fla. 33411

[21] Appl. No.: 811,072

[22] Filed: Dec. 20, 1991

[51] Int. Cl.[5] ..... A47B 63/00

[52] U.S. Cl. ..... 312/183; 312/193.4; 206/232; 281/31

[58] Field of Search ..... 312/183, 184, 188, 193.4; 206/232; 281/31; 40/159

[56] References Cited

U.S. PATENT DOCUMENTS

| | | | |
|---|---|---|---|
| 2,422,235 | 6/1947 | Greene | 281/31 |
| 3,464,135 | 12/1969 | Eidinger . | |
| 3,503,141 | 3/1970 | Schwartz | 281/31 |
| 3,758,136 | 9/1973 | Guyer | 281/31 |
| 3,829,132 | 8/1974 | Willieme | 281/31 |
| 3,958,690 | 5/1976 | Gee, Sr. | 206/232 |
| 4,273,397 | 6/1981 | Nolan | 312/183 |
| 4,306,737 | 12/1981 | Errichiello . | |
| 4,566,590 | 1/1986 | Manning et al. | 206/232 |
| 4,640,413 | 2/1987 | Kaplan et al. . | |
| 4,667,819 | 5/1987 | Lu | 40/159 |
| 4,711,348 | 12/1987 | Schluger | 206/232 |
| 4,765,466 | 8/1988 | Ivey | 206/232 |
| 4,793,477 | 12/1988 | Manning et al. | 206/232 |
| 4,867,310 | 9/1989 | Cannon et al. . | |
| 4,871,066 | 10/1989 | LaWall . | |
| 4,974,983 | 12/1990 | Givati | 281/31 |
| 5,022,522 | 6/1991 | Kennedy . | |
| 5,147,036 | 9/1992 | Jacobs | 206/232 |
| 5,161,907 | 11/1992 | Byrne | 281/31 |

FOREIGN PATENT DOCUMENTS

| | | | |
|---|---|---|---|
| 0195672 | 2/1938 | Switzerland | 281/31 |
| 0771788 | 4/1957 | United Kingdom | 206/232 |

OTHER PUBLICATIONS

*Halsey & Griffith* catalog, 1991, p. 470.

*Primary Examiner*—Victor N. Sakran

*Attorney, Agent, or Firm*—Quarles & Brady

[57] ABSTRACT

A multi-media storage device includes first and second panels connected together to store papers removably placed therebetween and a holder connected to one of the panels for storing and protecting a computer disk that holds computer-based information corresponding to the paper-based information. The multi-media storage device can be used in an information organizing system to correlate paper-based information and computer-based information.

14 Claims, 3 Drawing Sheets

MULTI-MEDIA STORAGE AND PROTECTION SYSTEM

FIELD OF THE INVENTION

The present invention relates to the field of file folders and similar storage devices. The invention relates more particularly to storage devices capable of storing paper-based information in association with other forms of information-based media.

BACKGROUND OF THE INVENTION

Historically, information has been documented on paper and stored in filing systems for subsequent review and use. In office environments, paper-based information, such as correspondence, client or product data and other forms of work product are recorded on paper and stored in file folders, typically organized according to the information retrieval behavior and characteristics of the particular office environment involved.

With the advent of computer-based storage systems, more and more business information has been stored in computer files. The use of computers for the storage of information can include storage of the information in the internal memory of a computer system or on external storage media, such as computer disks, commonly referred to as floppy disks.

While larger businesses may be able to afford the cost of a computer system having a sufficiently large internal memory for storage of all their computer-based information, smaller businesses and firms typically rely on external storage devices, such as the disks, for storing their computer-based information.

As computer-based storage systems have not completely been replaced by paper-based storage systems, the need to coordinate and cross-reference the information stored in file folders and the information stored on disks remains. While file names for computer files can be used to correlate particular stored documents with the associated file folders, these file names are not apparent from the external appearance of the disks. Under the conventional practice of storing a collection of disks at a computer operator's desk in stacked registry, the practice of repetitively inserting and checking a series of disks to locate the file needed is both inefficient and quite prevalent in the business world.

One known technique for reducing the time necessary to locate desired computer files is to provide indexing labels on the outer surfaces of the disks stored in the stacked registry. This system can be unreliable as it requires attention to the creation of an appropriate label at the time a disk is first used or a particular file is first stored on the disk. Additionally, correction to the index may be necessary if the computer file name is changed. In practice, this indexing and labeling system may not be followed by personnel in a busy office environment.

Sleeves for storing disks in three-ring binders, hanging file frames, and expandable pockets are known, but these devices are primarily designed for archival purposes and do not eliminate the need to manually index the information stored on the disks. Moreover, these devices are not adapted for transport of the computer disks in association with related paper-based documents as the sleeves provide no means for retaining the disks during movement, nor are the papers able to be secured in transport.

SUMMARY OF THE INVENTION

An object of the invention is to provide a multi-media storage system for coordinating paper-based information and computer-based information in an office environment for efficient coordination and retrieval.

Another object of the invention is to provide a multi-media storage system which is relatively easy to use.

A further object of the invention is to provide a multi-media storage system which is relatively inexpensive to implement in an office environment.

Still another object of the invention is to provide a multi-media storage system which can be retrofitted to an existing paper-based filing system.

Yet another object of the invention is to provide a multi-media storage system which provides reliable correlation between paper-based information and computer-based information and simultaneously protects the computer-based storage media.

These and other objects of the invention are achieved by a storage device having first and second panels for storing and protecting paper documents removably stored therebetween and a holder attached to one of the panels for removably storing and protecting a computer disk that stores computer-based information corresponding to the paper documents. The holder can be constructed to define a pocket having an inlet arranged so that the disk is stored and protected parallel to the panel. The pocket can be dimensioned to snugly hold a standard 5¼ inch floppy diskette, a 3½ inch disk, a CD ROM or other portable computer information storage medium which may be developed. The holder can have a front wall and a back wall which define the pocket, and the back wall can be adhered to the panel.

According to the invention, the disk holder can be placed on an external surface of the file folder so that the stored disk can be readily accessed without removing the file folder from the filing cabinet or opening the file folder. Accordingly, when modification or manipulation of the computer information without corresponding treatment of the paper-based information is desired, the computer disk can be readily accessed by spreading the file folders at the location of the disk and removing the disk from the holder.

The holder can include a closure constructed to open and close over the inlet to protect the disk during storage in a filing cabinet. Because the file folder and associated disk are typically removed for use away from the filing cabinet, the closure prevents accidental escape of the disk during transit. The closure can be a flap constructed of a flexible material for moving between an open and a closed position and can be secured in the closing position by a variety of securing means.

Another aspect of the invention is to provide a disk holder which can be retrofit to an existing file folder. The retrofit holder and protector can include a front wall and an adhesive back portion connected thereto for attachment to the panel of a file folder, whereby the file folder panel serves as the back wall for the disk holder. Alternatively, the retrofit disk protector can be constructed as an envelope with double stick adhesive along a back panel of the envelope.

The invention also provides a method for organizing information in an office environment, in which computer disks which hold computer-based information corresponding to paper-based information stored file folders can be readily stored in the association with the respective file folders, thereby utilizing the office indexing system for the file folders to automatically index the associated computer-based information. Thus the time, expense and unreliability associated with a separate indexing system for the computer disks is alleviated by the association of the disks with the corresponding file folders.

BRIEF DESCRIPTION OF THE DRAWINGS

A more detailed understanding of the invention can be gained by a reading of the following description in association with the accompanying drawings, in which.

DETAILED DESCRIPTION OF THE PREFERRED EMBODIMENTS

Referring to the figures, the invention is directed to a multi-media storage system for coordinating paper-based information and computer-based information in an office environment for efficient coordination and retrieval. The multi-media storage system can include a file folder for storing paper-based information and an associated holder for storing a computer disk which holds computer-based information corresponding to the paper-based information.

Figure 1:
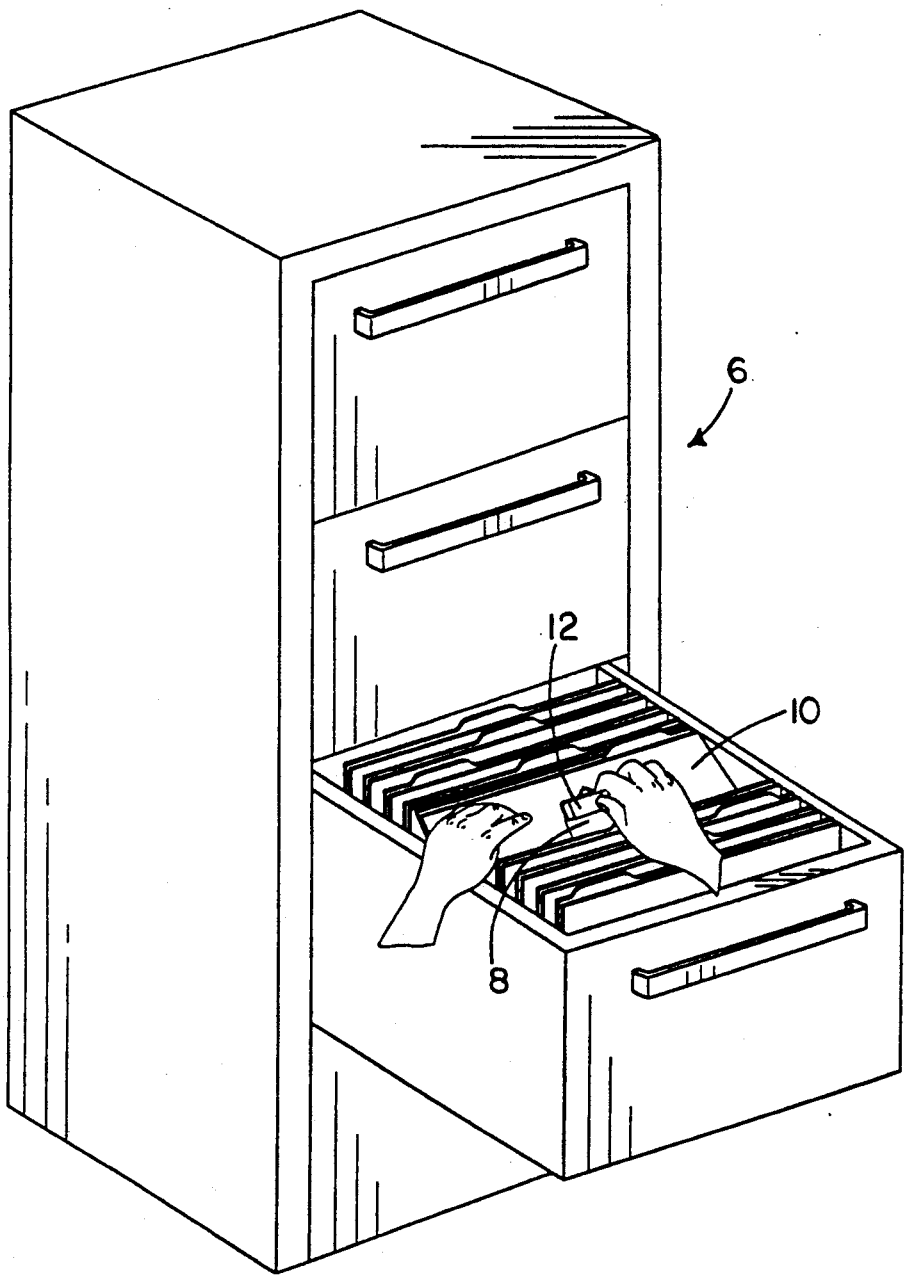
FIG. 1 is a perspective view of a file cabinet, illustrating a preferred use of the file folder of the invention.

Referring to FIG. 1, the multi-media storage device can be used to simultaneously store and protect associated paper-based information and computer-based information in one location such as a filing cabinet 6. The disk holder 8 is preferably placed on an outer surface of a file folder 10 to allow easy access to the disk 12 without removal of the associated file folder 10. By simply spreading the folders at the location of the desired disk 12, the disk 12 can be retrieved for modification or manipulation of the computer-based information without removing the associated folder 10.

Figure 2:
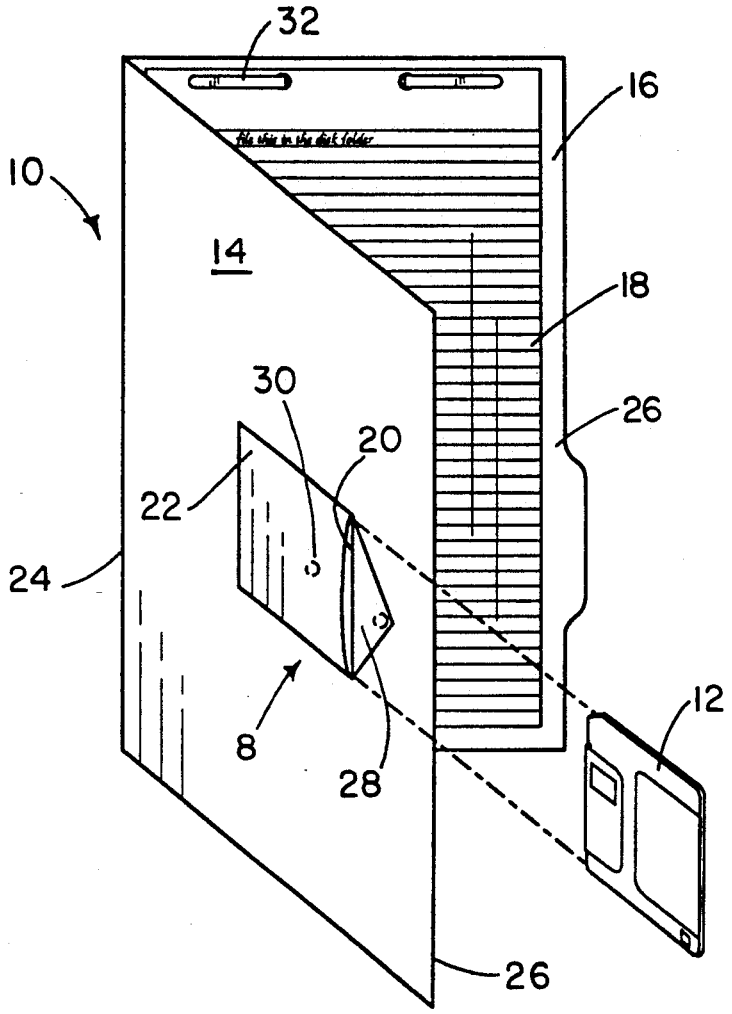
FIG. 2 is perspective view of an embodiment of the multi-media storage device of the invention.

Referring to FIG. 2, the file folder 10 can have a first panel 14 and a second panel 16 for storing and protecting paper-based information 18 removably stored therebetween. The paper-based information 18 can include correspondence, reports, invoices, memorandum and other printed information typically documented and stored in an office environment.

The holder 8 is attached to one of the panels 14 and 16 for removably storing and protecting the computer disks 12. The computer disk 12 is preferably a conventional 5¼ inch diskette or a 3½ disk (as shown). However, the computer disk 12 can also be a CD ROM or other computer data storage medium now known or later developed. The computer disk 12 10 preferably stores computer-based information corresponding to the paper-based information stored in the file folder 10.

The corresponding computer-based information on the disk 12 can include word processing files of the information stored on the paper 18. For example, the disk 12 can store a computer-based file of a report printed on paper 18 in the file folder 10 and stored for modification and revision in the computer file.

The corresponding computer-based information can also include lists, charts, tables and other information which is related to the paper-based information 18 stored in the file folder 10. The computer disk 12 can store lists, such as mailing lists of customers who are potentially interested in a product described in the paper-based documents 18 stored in the file folder 10. As another example, the computer disk 10 can store the computer file for a continually updated report on manufacturing performance levels, a printed copy of which is stored in the associated file folder 10 with related correspondence, memorandum notes and the like.

The holder 8 can be constructed to define a pocket having an inlet 20 arranged so that the disk 12 is stored and protected parallel to the panel 14. The holder 8 can be dimensioned to snugly hold a standard 5¼ inch floppy diskette, a 3½ inch disk, or a CD ROM or other portable computer information storage medium which may be developed. The holder 8 can have a front wall 22 and a back wall 24 (see FIG. 3), which define the pocket, and the back wall 24 can be adhered to the panel 14.

While the holder 8 can be attached to the inside of the folder 10, the holder 8 is preferably attached to the exterior of the folder 10 to permit easy access to the disk 12 during file storage without removing the file folder 10 from a storage cabinet or opening the file folder 10. File folders 10 stored in filing cabinets 6 or similar enclosures can be difficult to remove, particularly when the file folders 10 are tightly packed. Additionally, it is a known practice to secure the contents of a file folder 10 by wrapping a rubberband about the file folder 10. This banding makes access to the file folder contents difficult, particularly when the file folder remains in the filing cabinet 6.

According to the invention, the disk holder 8 can be placed on an external surface of the file folder panel 14 so that the stored disk 8 can be readily accessed without removing the file folder 10 from the filing cabinet 6 or attempting to open a file folder 10 secured by a rubberband.

To further facilitate the retrieval of the disk 8 from the holder B, the holder inlet 20 can be oriented on the folder panel 14 to open in the same direction as the folder 10 opens, thereby being directed upwardly when the folder is stored in conventional manner with the spine 24 down and the folder opening up. Additionally, the holder inlet 20 can be positioned proximate the folder opening edges 26, perhaps within one inch, to further enhance the retrievability of the disk 12.

The holder 8 can include closure, such as a flap 28 constructed to open and close over the inlet 20 to protect the disk 12 during storage. Because the file folder 10 and associated disk 12 are removed for use away from the filing cabinet 6, the closure 28 prevents accidental escape of the disk 8 during transit. Thus the storage device can also be used as a multi-media transport device and can have extra-office applications, such as a document carrier for a computer science student. The closure flap 28 can be constructed of a flexible material for moving between an open and a closed position and can be secured in the closing position by a variety of holding means. The holding means can include velcro, a button and string assembly, a snap assembly 30 or the like. Alternatively, the flap 28 can be constructed to tuck into the inlet in a relatively secure manner. The closure can alternatively be constructed by a ziplock or velcro seam or other closure structure.

The disk holder 8 is preferably manufactured integrally with the associated file folder 10, and both the file folder 10 and the holder 8 are preferably constructed of conventional 11 point paper. This paper weight provides lateral protection to the disk 12 and is conventional in folder manufacture. Various manufacturing and bonding techniques known in the art can also be utilized to securely attach the holder 8 to the file folder 10.

The preferred mode of carrying out the invention contemplates the use of the computer disk holder 8 on a panel of the conventional file folder 10 having first and second panels 14 and 16 joined along common edges 24 to pivotally open at the opposing edges 26. These conventional file folders 10 come in variety of shapes and sizes and can have various means for securing paper documents within. The securing means can include prongs 32, clips and the like. The file folder 10 can also include internal sleeves for separating and organizing the stored paper documents 16.

Figure 3:
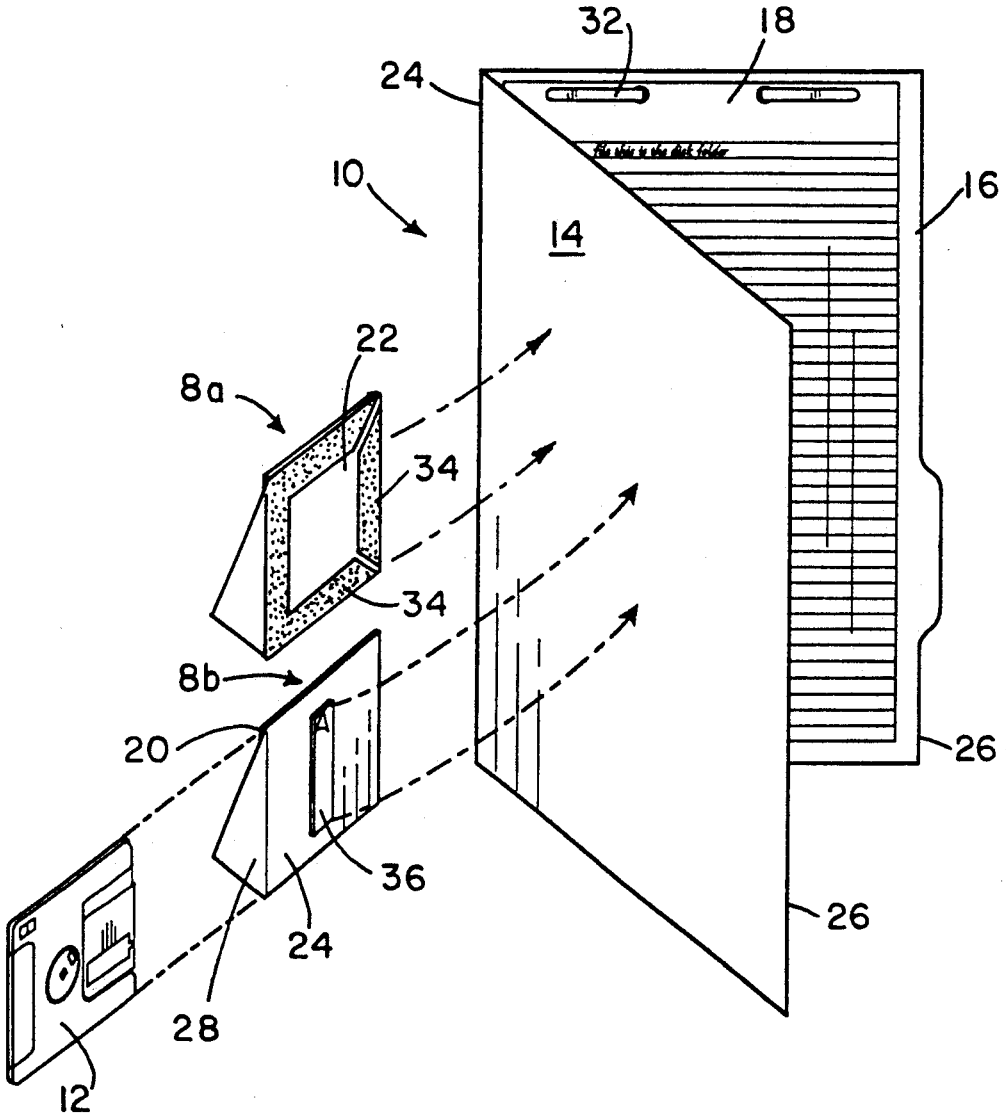
FIG. 3 is perspective view of the multi-media storage device of the invention, illustrating the retrofit capabilities of the device.

Referring to FIG. 3, the disk holder **8*a* can be constructed to retrofit to an existing file folder 10. The retrofit holder 8*a* can include a front wall 22*a* and a back portion, such as flaps 34, connected thereto for attachment to the panel 14 of the file folder 10, whereby the file folder panel 14 serves as the back wall for the disk holder 8*a*. The use of relatively small adhesive flaps 34 along the side and bottom edges of the front wall 22 can reduce the quantity of material necessary for the holder 8*a* and thereby reduce manufacturing costs. Alternatively, the retrofit disk holder and protector can be constructed as an envelope 8*b* with double stick adhesive 36 along a back panel of the envelope 8*b*. The retrofit holders 8*a* and 8*b*** can be constructed in a variety of shapes and sizes to accommodate disks of varying sizes and shapes.

The multi-media storage device can be used to organize information in an office environment in which computer disks holding computer-based information corresponding to paper-based information stored file folders can be readily stored in the association with the respective file folders, thereby utilizing the office indexing system for the file folders to automatically index the associated computer-based information. Thus the time, expense and unreliability associated with a separate indexing system for the computer disks is alleviated by the association of the disks with the corresponding file folders.

The foregoing description and drawings are intended to present preferred details of the invention and are not intended to limit the scope of the invention. Many alternatives and modifications within the scope of the invention will likely now be apparent to those skilled in the art in view of the teachings of this disclosure. For example, the holder can be modified to include a series of lines on its front face for the placement of indexing information relation to the computer files stored on the disks. Accordingly, the scope of the invention should only be determined from a reasonable interpretation of the appended claims.

I claim:

1. A multi-media storage system for storing and protecting paper-based information in association with corresponding computer-based information, said system comprising:

a plurality of file folders, each having first and second panels pivotally joined at bottom edges and opening at opposing top edges;

a plurality of sheets of paper for recording paper-based information stored thereon between said first and second panels;

a computer disk for storing computer-based information corresponding to said paper-based information; and a holder attached to said first panel of said each of said file folders for removably holding and protecting said disk, whereby a body of computer-based information and an associated body of paper-based information can be physically organized and coordinated together in one location.

2. The storage device according to claim 1, wherein the holder includes a pocket having an inlet arranged to permit insertion and retrieval of the disk substantially parallel to the first panel.

3. The storage device according to claim 2, wherein said first and second panels open at top edges and said holder is oriented to provide an inlet which is open toward the direction of the top edge of said first panel.

4. The storage device according to claim 3, wherein the holder opening is disposed substantially adjacent to the top edge of said first panel.

5. The storage device according to claim 2, wherein the pocket is dimensioned to substantially snugly hold a 5¼ inch computer diskette.

6. The storage device according to claim 2, wherein the pocket is dimensioned to substantially snugly hold a 3½ inch computer disk.

7. The storage device according to claim 2, wherein the pocket is dimensioned to substantially snugly hold a CD.

8. The storage device according to claim 2, wherein the first and second panels form a folder.

9. The storage device according to claim 2, wherein the pocket is attached on an outer surface of said first panel, opposite said second panel.

10. The storage device according to claim 2, wherein the holder includes a closure for covering the inlet to prevent accidental escape of the computer disk.

11. The storage device according to claim 10, wherein the closure is a movable flap.

12. The storage device according to claim 11, further comprising holding means for removably holding the flap over the inlet.

13. The storage device according to claim 1, wherein the holder has a front wall and a back wall which define a pocket, said back wall being connected to said first panel.

14. The storage device according to claim 13, wherein the back wall is secured by adhesive.

* * * * *